US009627113B2

(12) United States Patent
Enokido et al.

(10) Patent No.: US 9,627,113 B2
(45) Date of Patent: Apr. 18, 2017

(54) R-T-B BASED SINTERED MAGNET

(71) Applicant: TDK CORPORATION, Tokyo (JP)

(72) Inventors: Yasushi Enokido, Tokyo (JP); Daisuke Tanaka, Tokyo (JP)

(73) Assignee: TDK CORPORATION, Tokyo (JP)

( * ) Notice: Subject to any disclaimer, the term of this patent is extended or adjusted under 35 U.S.C. 154(b) by 361 days.

(21) Appl. No.: 14/258,524

(22) Filed: Apr. 22, 2014

(65) Prior Publication Data

US 2014/0311290 A1 Oct. 23, 2014

(30) Foreign Application Priority Data

Apr. 22, 2013 (JP) ..... 2013-089522
Mar. 26, 2014 (JP) ..... 2014-063001

(51) Int. Cl.
*H01F 1/053* (2006.01)
*H01F 1/057* (2006.01)

(52) U.S. Cl.
CPC ..... *H01F 1/0536* (2013.01); *H01F 1/0577* (2013.01)

(58) Field of Classification Search
CPC ..... H01F 1/0536
See application file for complete search history.

(56) References Cited

U.S. PATENT DOCUMENTS 7,618,497 B2 * 11/2009 Kato ..... H01F 1/0577 148/302
2009/0019969 A1 * 1/2009 Kato ..... C22C 33/0278 75/228
2013/0009736 A1 1/2013 Honkura et al.

FOREIGN PATENT DOCUMENTS

| | | |
|---|---|---|
| CN | 102648502 A | 8/2012 |
| EP | 0 101 552 A2 | 2/1984 |
| JP | A-59-46008 | 3/1984 |
| JP | A-2011-187624 | 9/2011 |

* cited by examiner

*Primary Examiner* — Jessee Roe
*Assistant Examiner* — Christopher Kessler
(74) *Attorney, Agent, or Firm* — Oliff PLC

(57) ABSTRACT

The present invention provides a permanent magnet with a coercivity that will not be significantly decreased and a light weight compared to conventional R-T-B based permanent magnets. A core-shell structure is formed for the major phase grain by adding Cu to the R-T-B based magnet which is the raw material. When the mass concentration of Y in the core portion is set as EY, the mass concentration of Y in the shell portion is set as LY and the mass concentration of Y in the $R_2$—$Fe_{14}$—B crystal grain calculated from the ratio R1:Y in the total composition is set as SY, the ratio $\alpha$ of EY to SY (EY/SY) is 1.1 or more. Thus, the magnetic insulation among the crystal grains becomes better which prevents the coercivity from decreasing due to the addition of Y. Further, the addition of Y makes the magnet lighter in weight.

6 Claims, No Drawings

R-T-B BASED SINTERED MAGNET

The present invention relates to a rare earth based permanent magnet, especially a permanent magnet obtained by selectively replacing part of the R in the R-T-B based permanent magnet with Y.

BACKGROUND

The R-T-B based permanent magnet (R represents a rare earth element, T represents Fe or Fe with part of it replaced with Co, and B represents boron) comprising a tetragonal compound $R_2T_{14}B$ as the major phase is known to have excellent magnetic properties and has been considered as a representative permanent magnet with good performances since it was invented in 1982 (Patent Document 1: JP Sho59-46008).

In particular, the R-T-B based magnets in which the rare earth element R consists of Nd, Pr, Dy, Ho or Tb have large magnetic anisotropy fields Ha and are preferred as materials for permanent magnets. Especially the Nd—Fe—B based magnet having Nd as the rare earth element R is widely used in people's livelihood, industries, conveyer equipment and the like, because it has a good balance among saturation magnetization Is, curie temperature Tc and magnetic anisotropy field Ha and is better in resource volume and corrosion resistance issues than R-T-B based permanent magnets with other rare earth elements.

The motors used in people's livelihood, industries, conveyer equipment and the like, most of which are required to have variable speeds, are mainly inverter driven by induction motors with simple constructions and low prices. However, recently, in order to save energy, people tend to use the permanent-magnet synchronous motor which has a higher efficiency than the induction motor.

In the permanent-magnet synchronous motor, a permanent magnet is disposed in the rotor and the used permanent magnet is one having one third of the masses occupied by the rare earth element Nd with a big specific gravity (just as the Nd—Fe—B based magnet), causing increased inertia momentum due to the elevated weight of the rotor. That is, the controllability and efficiency are deteriorated.

PRIOR ART

Patent Documents

Patent Document 1: JP59-46008

Patent Document 2: JP2011-187624

With respect to the R in the R-T-B based magnet, Y is known as an element lighter than Nd. Patent Document 2 has disclosed a Y-T-B based magnet having Y as the rare earth element R in the R-T-B based magnet. Although the $Y_2$—$F_{14}$—B phase having a small magnetic anisotropy field Ha is the major phase, a magnet with a practical coercivity can be obtained by increasing the amounts of Y and B to levels larger than those based on the stoichiometric composition of $Y_2Fe_{14}B$. However, the Y-T-B based magnet disclosed in Patent Document 2 has HcJ of about 250 to 350 kA/m. The magnetic properties of this magnet is much worse than the Nd—Fe—B based magnet, so the Y-T-B based magnet can hardly replace conventional Nd—Fe—B based magnets to be used as a light (in weight) permanent magnet for the permanent-magnet synchronous motor

SUMMARY

Based on the problems mentioned above, the present invention aims to provide a light (in weight) permanent magnet whose coercivity will not be significantly deteriorated compared to the R-T-B based magnets which are widely used in people's livelihood, industries, conveyer equipment and so on.

The R-T-B based permanent magnet is a R-T-B based sintered magnet (wherein, Y (yttrium) and R1 are necessary, R1 represents at least one rare earth element except Y, and T represents one or more transition metal elements containing Fe or the combination of Fe and Co as essential) comprising major phase grains, wherein, the grain contains a core portion and a shell portion which covers the core portion. When the mass concentration of Y in the core portion is set to be EY, the mass concentration of Y in the shell portion is set to be LY, and the mass concentration of Y in the $R_2$—$Fe_{14}$—B crystal grain calculated from the ratio R1:Y in the total composition is set to be SY, the ratio $\alpha$ of EY to SY ($\alpha$=EY/SY) is 1.1 or more. With such a structure, a R-T-B based sintered magnet showing a high coercivity and a light weight will be obtained among the R-T-B based sintered magnets.

The inventors have found that a light permanent magnet will be obtained while the high coercivity can be maintained by appropriately arranging elements in the crystal grains and crystal grain boundary in RTB based permanent magnet of the present invention, especially by increasing the concentration of Y in the core portion of the crystal grain and lowering the concentration of Y in the grain boundary. In this way, the present invention is completed.

In the present invention, compared to the R-T-B based magnet in which the same amount of Y has been uniformly added, a R-T-B based magnet in which Y is mainly disposed in the core and R1 other than Y is mainly disposed in the grain boundary will have a higher coercivity. In addition, with the addition of Y, a magnet will be obtained lighter than the R-T-B based magnet without Y

DETAILED DESCRIPTION OF EMBODIMENTS

The present invention is described in detail based on the embodiments. Further, the present invention is not limited by the following embodiments and examples. In addition, the constituent elements in the following embodiments and examples include those easily thought of by those skilled in the art, those substantially the same and those having the equivalent scopes. Besides, the constituent elements disclosed in the following embodiments and examples can be appropriately combined or can be properly selected.

The R-T-B based sintered magnet of the present embodiment contains 11 to 18 at % of the rare earth element R. Here, the R in the present invention contains Y (yttrium) and R1 as the essential ingredients, and R1 represents at least one rare earth element except Y If the amount of R is less than 11 at %, the $R_2T_{14}B$ phase as the major phase in the R-T-B based sintered magnet will not be sufficiently generated. Also, the soft magnetic $\alpha$-Fe and the like will precipitate and the coercivity is significantly decreased. On the other hand, if the amount of R is larger than 18 at %, the volume ratio of $R_2T_{14}B$ phase as the major phase will be decreased, and the residual flux density is reduced. Further, R reacts with O. As the amount of O contained therein increases, the R-rich phase effective in producing coercivity is reduced, resulting in the decrease of the coercivity.

In the present embodiment, the rare earth element R mentioned above contains Y and R1. R1 represents at least one rare earth element except Y. Here, R1 could also contain other components which are impurities derived from the starting material or impurities mixed during the production process. In addition, if a high magnetic anisotropy field is considered to be desired, R1 is preferred to be Nd, Pr, Dy, Ho and/or Tb. In view of the price of the starting materials and the corrosion resistance issue, Nd is more preferred. With respect to the rare earth element R, the ratio of R1 to Y is preferably in the range of 50:50 to 90:10. The reason is that the coercivity tends to decrease if Y account for more than 50 at % while the effect on the light weight tends to be weakened if the content of Y is less than 10%.

The R-T-B based sintered magnet of the present embodiment contains 5 to 8 at % of B (boron). When B accounts for less than 5 at %, a high coercivity cannot be obtained. In another respect, if B accounts for more than 8 at %, the residual magnetic density tends to decrease. Thus, the upper limit for the amount of B is 8 at %.

The R-T-B based sintered magnet of the present embodiment may contain 4.0 at % or less of Co. Co forms a same phase as Fe but has effects on the increase of the curie temperature as well as the increase of the corrosion resistance of the grain boundary phase.

Further, the R-T-B based permanent magnet applied in the present embodiment may contain 0.01 to 1.2 at % of Al. By containing Al with the mentioned range, the coercivity can be elevated.

Further, in the present embodiment, the Y becomes dense in the core portion of the crystal grain by adding Cu. Especially in the preparation of the strip cast (SC) alloys, the Y becomes dense by thickening the alloys. The underlying mechanism why Y becomes denser with the addition of Cu or with the thickening of the alloys is not clearly known. The SC alloy is prepared by melting the raw alloy and letting the melted liquid flow into a rolling copper roller and then cool down there. The alloy will be cooled down if its thickness becomes thicker, and the growth rate of the $R_2T_{14}B$ dendritic crystal is lowered accordingly which would promote Y to become denser. Although it is not known how Cu functions here, Y is probably rejected because of the combination of Nd and Cu. Cu is preferably added in an amount of 0.4 wt % or less. If too much Cu is added, the coercivity will be decreased.

The R-T-B based sintered magnet of the present embodiment is allowed to contain other elements. For example, elements such as Zr, Ti, Bi, Sn, Ga, Nb, Ta, Si, V, Ag, Ge and the like can be appropriately contained. In another aspect, it is preferred that the impurity elements such as O, N (nitrogen), C (carbon) and the like are decreased to an extreme extent. Especially, the amount of O which damages the magnetic properties is preferably 5000 ppm or less, and more preferably 3000 ppm or less. This is because the phase of rare earth oxides as the non-magnetic components increases in volume if O is contained in a large amount, leading to lowered magnetic properties.

The R-T-B based sintered magnet of the present embodiment comprises major phase grains and the major phase grain contains a core portion and a shell portion which covers the core portion. When the mass concentration of Y in the core portion is set to be EY, the mass concentration of Y in the shell portion is set to be LY, and the mass concentration of Y in the $R_2$—$Fe_{14}$—B crystal grain calculated from the ratio R1:Y in the total composition is set to be SY, the ratio $\alpha$ of EY to SY ($\alpha$=EY/SY) is 1.1 or more. In the R-T-B based sintered magnet of the present embodiment, R includes Y (yttrium) and R1, and the concentration of Y inside the crystal grain (i.e., the core portion) can be relatively elevated. Thus, the concentration of Nd in the crystal boundary is increased and the magnetic insulation of the crystal grain becomes better, leading to a higher coercivity compared to the conventional Y-T-B based magnet. In addition, the ratio $\beta$ of LY to SY ($\beta$=LY/SY) is preferred to be 0.9 or more and 1.1 or less. Further, R1 is preferred to be at least one of Nd, Pr, Dy, Ho and Tb.

If the $R_2$—$Fe_{14}$—B crystal grain is uniformly formed without a core-shell structure, the concentration of Y in the grain boundary phase becomes higher compared to the R-T-B based sintered magnet of the present embodiment. As Y tends to precipitate in the grain boundary phase, the so called R-rich phase existing in the grain boundary between two grains in the $R_2$—$Fe_{14}$—B crystal grain will relatively decrease. If the R-rich phase is reduced, it is hard to maintain the magnetic insulation among the $R_2$—$Fe_{14}$—B crystal grains, leading to a lowered coercivity.

On the other hand, even if the grain has a core-shell structure, the concentration of Y in the grain boundary becomes higher if the concentration of Y in the shell portion is substantially decreased ($\beta$<0.9). Accordingly, it is more difficult to maintain the magnetic insulation, and the coercivity tends to decrease. If the concentration of Y in the shell portion is greatly increased ($\beta$>1.1), the coercivity will be decreased. This is because the magnetization reversal is likely to happen if the magnetic anisotropy filed of the shell portion of the crystal grain is small in the $R_2$—$Fe_{14}$—B with a nucleation type coercivity mechanism.

Hereinafter, the preferred examples of the preparation methods in the present invention will be described as follows.

In the preparation of the R-T-B based magnet in the present embodiment, the raw alloys are prepared for obtaining the R-T-B based magnet with the desired composition. The raw alloys can be produced by strip casting or the other known melting methods under vacuum or inert atmosphere (preferably Ar atmosphere). In the strip casting process, the melted liquid obtained by melting the raw metals under non-oxidative atmosphere such as Ar atmosphere is ejected to the surface of the rolling roller. The melted liquid quickly cooled down on the roller is rapidly solidified into a plate or a sheet (squama). The rapidly solidified alloy has a homogeneous structure with a crystal size of 1 to 50 μm.

In the case of obtaining the R-T-B based sintered magnet in the present invention, the raw alloy mainly applies to a so-called single-alloy method using one kind alloy to produce sintered magnets but also applies to a so-called mixing method using an alloy (low-R alloy) having $R_2Fe_{14}B$ crystal grains as the main body and an alloy (high-R alloy) containing more amount of R than that of the low-R alloy.

The raw metals or the raw alloys are weighted in accordance with the target composition, and the raw alloys are obtained via the strip casting under vacuum or inert atmosphere (preferably Ar atmosphere). The thickness of the alloy can be controlled by changing the rolling rate of the rollers or the supply rate of the melted liquid. For the purpose of the present invention, if the thickness of the alloy is too thin, the growth rate of the $R_2Fe_{14}B$ dendritic crystal becomes faster so that the Y will become dense. Also, chill crystallization is likely to happen, so orientation will be deteriorated. On the other hand, if the alloy is too thick, the $R_2Fe_{14}B$ dendritic crystal will be thick and large, leading to a lowered coercivity. Therefore, in the present embodiment, the thickness of the alloy is about 0.3 mm to 0.5 mm.

The raw alloys are subjected to the pulverization process. When the mixing method is used, the low-R alloy and the high-R alloy are pulverized separately or pulverized together. The pulverization process includes coarse pulverization and fine pulverization. Firstly, the raw alloys are coarsely pulverized to a particle size of about several hundreds of microns. The coarse pulverization is preferably performed by using a stamp mill, a jaw crusher, a braun mill and the like under inert atmosphere. Before the coarse pulverization, it will be effective if the hydrogen is occluded to the raw alloy and then released to perform the pulverization. The purpose of hydrogen-releasing treatment is to reduce the hydrogen which is the impurity of the rare earth-based sintered magnet. The heating process for the hydrogen adsorption is kept at a temperature of 200° C. or more, preferably 350° C. or more. The lasting time varies depending on the temperature, the thickness of the raw alloy and etc. but is at least 30 min or more, preferably 1 hour or more. The hydrogen-releasing treatment is preformed under vacuum or under Ar flow. Further, the hydrogen-occluding treatment and hydrogen-releasing treatment are not necessary. The hydrogen pulverization can be used to replace the coarse pulverization so that the mechanical coarse pulverization can be omitted.

After the coarse pulverization process, the fine pulverization is performed. During the fine pulverization process, a jet mill is mainly used to pulverize the coarsely pulverized powders with a particle size of approximately several hundreds of microns to finely pulverized powder with a particle size of 2.5 to 6 μm, preferably 3 to 5 μm. The jet mill discharges highly pressurized inert gases from a narrow nozzle and produces airflows with a high speed. The coarsely pulverized powders are accelerated with the airflows with a high speed, causing the coarsely pulverized powers to hit each other or to hit a target or the wall of a container. In this respect, pulverization is further performed.

The wet pulverization process can also be applied in the fine pulverization. In the wet pulverization, a ball mill, a wet mill or the like can be used to pulverize the coarsely pulverized powders having a particle size of approximately several hundreds of microns to finely pulverized powders with an average particle size of 1.5 to 5 μm, preferably 2 to 4.5 μm. By selecting a proper dispersing medium in the wet pulverization, the pulverization can be performed with the magnet powders unexposed to the oxygen so that fine powders with low content of oxygen can be obtained.

During the fine pulverization, about 0.01~0.3 wt % of fatty acids or the derivatives thereof or hydrocarbons can be added to improve the lubricating property and orientation upon molding, these substances being, for example, zinc stearate, calcium stearate, aluminium stearate, stearic amide, oleic amide, ethylene bis-isostearic amide as the stearic acids or oleic acids, paraffin and naphthalene as hydrocarbons and etc.

The fine powders mentioned above are molded in the magnetic field.

The molding pressure during the molding process in the magnetic field can be set in the range of 0.3 to 3 ton/cm$^2$, i.e., 30 to 300 MPa. The molding pressure can be constant from the beginning to the end, or can be increasing or decreasing gradually, or can be changing irregularly. The lower the molding pressure is, the better the orientation will be. However, if the molding pressure is much too low, problems arise during the handling due to insufficient strength of the molded article. From this point, the molding pressure should be selected from the range above. The final relative density of the molded article obtained in the magnetic field is usually 40 to 60%.

The magnetic field is applied in the range of about 10 to 20 kOe (960 to 1600 kA/m). The applied magnetic field is not limited to the static magnetic field, and it can also be a pulsed magnetic field. In addition, the static magnetic field and the pulsed magnetic field can be used in combination.

Then, the molded article is sintered under vacuum or inert atmosphere. The sintering temperature is required to be adjusted in accordance with conditions such as the composition, the pulverization process, the differences on the average particle sizes and grain size distribution and the like. The molded article is fired at 1000 to 1200° C. for 1 hour to 8 hours.

After sintered, the obtained sintered body is subjected to the aging treatment. Such a process is important to control the coercivity. When the aging treatment is divided into two stages, it will be effective to last for a predetermined time at about 800° C. and at about 600° C. If the thermal treatment is performed at about 800° C. after sintering, the coercivity will increase. In addition, as the thermal treatment of about 600° C. greatly elevates the coercivity, the aging treatment can be performed at about 600° C. when a one-stage aging treatment is provided.

Although embodiments to preferably carry out the present invention are described above, the structure in the present invention is obtained for example by increasing the ratio of Y in the core portion. In such a case, a grain boundary diffusion method also can be adopted in which powders containing R are attached to the surface of the sintered body or the layer containing R is formed as a film and then heated.

EXAMPLES

Hereinafter, Examples and Comparative examples are used to describe the present invention. However, the present invention is not limited to the following Examples.

Examples 1 to 7 and Comparative Example 1

Test Example 1

The composition of the raw alloy was 15.04 mol % R-6.50 mol % B—Fe (balance) with the addition of 0.5 wt % of Co, 0.18 wt % of Al or 0.1 wt % of Cu, or without any addition. In addition, with respect to R, it was Nd:Y=90:10 to 30:70 (mol:mol). The raw metals or the raw alloys were prepared in accordance with the composition mentioned above and then melted and casted to the plates of raw alloy via the strip casting process. The raw alloy aimed to be 0.4 mm in thickness. Thirty prepared alloy plates were measured for their thicknesses by a micrometer, and the average was used as the thickness of the alloys.

The obtained plates of raw alloy were subjected to the hydrogen pulverization to obtain the coarsely pulverized powders. Oleic amide was added to the coarsely pulverized powders as the lubricant. Thereafter, a fine pulverization was performed under the highly pressurized $N_2$ atmosphere by using a jet mill to obtain finely pulverization powders.

Subsequently, the finely pulverized powders were molded in a magnetic field. To be specific, molding was performed in the magnetic field of 1200 kA/m (15 kOe) under a pressure of 140 MPa, and then a molded article with 20 mm×18 mm×13 mm in size was obtained. The direction of the magnetic field was a direction vertical to the pressing direction. Next, the obtained molded article was fired at 1090° C. for 2 hours. Thereafter, an aging treatment for one hour at 850° C. and another hour at 530° C. was provided so that a sintered body was obtained.

The obtained sintered body was buried into the epoxy resin, and its section was polished. A commercially available abrasive paper was used during the polishing process. During the polishing process, the abrasive paper was changed from one with a low particle size number to another with a higher particle size number. Finally, a buff and a diamond abrasive grain were adopted to perform the polishing process without water and the like. The components in the grain boundary phase would be corroded if water was used.

The composition distribution in the polished samples was studied by using an electron probe micro-analyzer (EPMA). The core portion and the shell portion in the major phase grain were determined by observing the reflected electron images from the electron microscopy and the EPMA images. With respect to these issues, a quantitative analysis was applied to at least 30 points for each issue so as to obtain the average composition (mass concentration). The mass concentration of Y in the core portion was set as EY, and the mass concentration of Y in the shell portion of the crystal grain was set as LY.

The R-T-B based sintered magnet generally contained more amount of R than $R_2$—$Fe_{14}$—B. This is because it would be difficult to obtain enough coercivity only depending on the major phase (i.e., the $R_2$—$Fe_{14}$—B phase) which provided the magnetic performance. Adding a relatively high amount of R enabled the magnetic insulation among the major phase grains, leading to a higher coercivity. Thus, the composition of the major phase grains differed from that of the total magnet containing the crystal boundaries. The mass concentration of Y in the $R_2$—$Fe_{14}$—B crystal grains was set as SY assuming that the ratio R1:Y in the total composition was the ratio R1:Y for R in the $R_2T_{14}B$ grains. Further, the total composition could be known by analyzing the magnet itself by ICP-AES (inductively coupled plasma atomic emission spectroscopy).

The ratio of EY to SY (i.e., EY/SY) was set to be $\alpha$. If $\alpha$ was close to 1, the concentration of Y in the core portion was close to that in the total composition; if $\alpha$ was larger than 1, Y was dense in the core portion. The ratio of LY to SY (i.e., LY/SY) was set to be $\beta$. If $\beta$ was close to 1, the concentration of Y in the shell portion was close to that in the total composition; if $\beta$ was smaller than 1, Y became sparse in the shell portion. In addition, the ratio of EY to LY (i.e., EY/LY) was set as $\chi$. If $\chi$ was close to 1, the composition inside the crystal grain was uniform and the core-shell structure was not formed. If $\chi$ was larger than 1, the larger the $\chi$ was, the denser the Y was in the core portion.

The coercivity (HcJ) of these samples was measured by a BH tracer. The results were shown in Table 1. The ratio R1:Y, whether in the single-alloy method or the double-alloy method, represented the molar ratio of R1 to Y in the final prepared alloy.

TABLE 1

| | Ratio R1:Y | Species of R1 | Species of added substance | Thickness of alloy (mm) | Concentration of added substance (wt %) | Density (g/cc) | SY (wt %) | EY (wt %) | LY (wt %) | $\alpha$ = EY/SY | $\beta$ = LY/SY | $\chi$ = EY/LY | HcJ (kA/m) |
|---|---|---|---|---|---|---|---|---|---|---|---|---|---|
| Example 1 | 90:10 | Nd | Cu | 0.41 | 0.1 | 7.44 | 1.66 | 1.92 | 1.60 | 1.16 | 0.96 | 1.21 | 926 |
| Example 2 | 80:20 | Nd | Cu | 0.39 | 0.1 | 7.42 | 3.36 | 4.04 | 3.41 | 1.20 | 1.01 | 1.19 | 900 |
| Example 3 | 70:30 | Nd | Cu | 0.41 | 0.1 | 7.36 | 5.09 | 5.92 | 5.08 | 1.16 | 1.00 | 1.17 | 819 |
| Example 4 | 60:40 | Nd | Cu | 0.40 | 0.1 | 7.30 | 6.86 | 8.58 | 6.96 | 1.25 | 1.01 | 1.23 | 789 |
| Example 5 | 50:50 | Nd | Cu | 0.42 | 0.1 | 7.21 | 8.67 | 10.51 | 8.79 | 1.21 | 1.01 | 1.20 | 741 |
| Example 6 | 40:60 | Nd | Cu | 0.43 | 0.1 | 7.18 | 10.51 | 12.76 | 10.48 | 1.21 | 1.00 | 1.22 | 682 |
| Example 7 | 30:70 | Nd | Cu | 0.40 | 0.1 | 7.11 | 12.40 | 14.83 | 12.40 | 1.20 | 1.00 | 1.20 | 638 |
| Example 8 | 50:50 | Nd | Cu | 0.41 | 0.2 | 7.23 | 8.67 | 10.79 | 8.61 | 1.25 | 0.99 | 1.25 | 760 |
| Example 9 | 50:50 | Nd | Cu | 0.42 | 0.3 | 7.23 | 8.67 | 11.00 | 8.80 | 1.27 | 1.02 | 1.25 | 759 |
| Example 10 | 50:50 | Nd | Cu | 0.50 | 0.1 | 7.21 | 8.67 | 10.59 | 7.66 | 1.22 | 0.88 | 1.38 | 623 |
| Example 11 | 50:50 | Nd, Dy | Cu | 0.42 | 0.1 | 7.21 | 8.67 | 10.48 | 8.90 | 1.21 | 1.03 | 1.18 | 916 |
| Comparative Example 1 | 50:50 | Nd | Cu | 0.40 | 0.0 | 7.24 | 8.67 | 8.43 | 7.83 | 0.97 | 0.90 | 1.08 | 567 |
| Comparative Example 2 | 50:50 | Nd | V | 0.41 | 0.1 | 7.23 | 8.67 | 8.61 | 8.21 | 0.99 | 0.95 | 1.05 | 558 |
| Comparative Example 3 | 50:50 | Nd | Nd | 0.42 | 0.1 | 7.22 | 8.67 | 8.72 | 8.55 | 1.01 | 0.99 | 1.02 | 552 |
| Comparative Example 4 | 50:50 | Nd | Cu | 0.26 | 0.1 | 7.24 | 8.67 | 8.86 | 8.55 | 1.02 | 0.99 | 1.04 | 404 |
| Comparative Example 5 | 50:50 | Nd | Cu | 0.41 | 0.0 | 7.23 | 8.67 | 8.78 | 7.26 | 1.01 | 0.84 | 1.21 | 478 |

It can be known from Examples 1 to 7 that if the ratio of Y became high, the coercivity gradually decreased; if the value for any $\alpha$ was larger than 1, Y became dense in the core portion. In addition, if $\beta$ was close to 1, the concentration was close to that in the total composition. In Comparative Example 1, without of the addition of Cu, the composition in the core portion was substantially the same as the total composition. However, it showed that the concentration of Y in the shell portion was decreased and Y became dense in the crystal boundary. This result showed that the coercivity was lower compared to Example 5 in which the total composition for R was the same. This was because Y was hard to be wet with the crystal grains at the boundary between two grains and easy to solidify at the triple point. Thus, the magnetic insulation among crystal grains was not sufficient at the boundary where Y was dense. In Examples 1 to 7, the magnetic insulation among crystal grains became easier by making Y dense in the core portion which increased the amount of Nd in the crystal boundary. It was predicted that Y became denser towards the core portion because Y was rejected by the combination between Nd and Cu.

Examples 8 to 9

Test Example 2

The samples were prepared as in Example 1 except that the concentrations of the added Cu were respectively 0.2 wt % and 0.3 wt %. The results were shown in Table 1. Y became denser towards the core portion by elevating the concentration of Cu. And the coercivity was increased too.

Example 10

Test Example 3

The sample was prepared as in Example 1 except that the target thickness of the raw alloy plate was 0.5 mm. The result was shown in Table 1. As the thickness of the alloy was quite thick, it took time to cool the alloy, which promoted Y to disperse from the $R_2Fe_{14}B$ dendritic crystal to the so-called R-rich phase. In this respect, β decreased slightly and thus the coervicity decreased.

Example 11

Test Example 4

The sample was prepared as in Example 1 except that R was set to be Nd:Dy:Y (mol:mol:mol)=47:3:50. The result was shown in Table 1. The addition of Dy elevated the coercivity but caused Y to be denser towards the core portion just as what happened in Example 5.

Comparative Examples 2 to 3

Test Example 5

The samples were prepared as in Example 1 except that 0.1 wt % of V and 0.1 wt % of Nd were respectively added to replace Cu. The results were shown in Table 1. In the samples with the addition of V or Nd, χ(=EY/LY) was almost 1 and the core-shell structure was not formed. As Nd would not be dense in the crystal boundary phase, the coercivity was lower than that in Example 5.

Comparative Example 4

Test Example 6

The sample was prepared as in Example 1 except that the target thickness of the raw alloy plate was 0.25 mm. The result was shown in Table 1. The α(=EY/SY) was almost equal to 1 and Y did not become dense. It was predicted that if the alloy was thin in thickness then there was no enough time for the $R_2T_{14}B$ dendritic crystal to grow, which would not cause Y to be dense. This result showed a low coercivity compared to Example 5.

Comparative Example 5

Test Example 7

The sample was prepared as in Example 1 except that no Cu was added and the time for firing was 8 hours. The result was shown in Table 1. Similarly to Comparative Example 1, without the addition of Cu, the composition in the core portion was substantially the same as the total composition. As the firing continued for a long time, Nd dispersed from the shell portion to the crystal boundary portion. Compared to Comparative Example 1, the Y in the shell portion was further decreased and became dense in the crystal boundary. Y was hard to be wet with the crystal grains at the boundary between two grains and easy to solidify at the triple point. Thus, the magnetic insulation among crystal grains was not sufficient at the crystal boundary where Y is dense. Compared to Example 5, the coercivity was lower.

What is claimed is:

1. A R-T-B based sintered magnet, wherein,

R contains Y and R1 as essential, Y is yttrium, R1 represents at least one rare earth element except Y, and T represents at least one transition metal element containing Fe or the combination of Fe and Co as essential, the R-T-B based sintered magnet comprises major phase grains with a core portion and a shell portion which covers said core portion, when the mass concentration of Y in the core portion is set as EY, the mass concentration of Y in the shell portion is set as LY and the mass concentration of Y in the $R_2$—$Fe_{14}$—B crystal grain calculated from the ratio of R1:Y in the total composition is set as SY, the ratio α of EY to SY (EY/SY) is 1.1 or more, and the R-T-B based sintered magnet contains Cu.

2. The R-T-B based sintered magnet according to claim 1, wherein, the ratio β of LY to SY (LY/SY) is more than 0.9 and less than 1.1.

3. The R-T-B based sintered magnet according to claim 1, wherein, R1 is at least one selected from the group consisting of Nd, Pr, Dy, Ho and Tb.

4. The R-T-B based sintered magnet according to claim 1, wherein, the concentration of Cu is 0.4 wt. % or less.

5. The R-T-B based sintered magnet according to claim 1, wherein, the concentration of Cu is in a range of from 0.1 wt. % to 0.4 wt. %.

6. The R-T-B based sintered magnet according to claim 1, wherein, the concentration of Cu is in a range of from 0.1 wt. % to 0.3 wt. %.

* * * * *